United States Patent [19]

Sakai et al.

[11] Patent Number: 4,869,076

[45] Date of Patent: Sep. 26, 1989

[54] WATER SUPPLY SYSTEM FOR ICE MAKING MACHINE

[75] Inventors: Tadashi Sakai; Shozo Ogata; Nobutaka Naruse, all of Toyoake, Japan

[73] Assignee: Hoshizaki Electric Co., Ltd., Aichi, Japan

[21] Appl. No.: 167,155

[22] Filed: Mar. 16, 1988

Related U.S. Application Data

[63] Continuation-in-part of Ser. No. 71,260, Jul. 8, 1987, abandoned.

[30] Foreign Application Priority Data

Mar. 16, 1987 [JP] Japan ..... 62-37209

[51] Int. Cl.[4] ..... F75C 1/12

[52] U.S. Cl. ..... 62/347; 415/204; 415/911

[58] Field of Search ..... 62/347; 415/152 A

[56] References Cited

U.S. PATENT DOCUMENTS 3,136,254 6/1964 Douglas ..... 415/152 A X 3,254,501 6/1966 Brysselbout ..... 62/347 X

*Primary Examiner*—William E. Tapolcai

*Attorney, Agent, or Firm*—Wenderoth, Lind & Ponack

[57] ABSTRACT

An ice making machine comprises an ice forming member, a water tank for storing ice forming water to be supplied to the ice forming member, a water distribution pipe for supplying ice forming water onto the ice forming member, a first pipe having one end connected to the water distribution pipe, and a circulating pump having an intake port communicated to the water tank. The circulating pump is of a reversible rotation type and includes a first discharge port connected to the other end of the first pipe for delivering ice forming water to the ice forming member during an ice production cycle, and a second discharge port connected to a second pipe for discharging water from the water tank to a location other than the water distribution pipe during a deicing cycle. The location at which the second pipe discharge water can be a defreezing water distribution pipe for supplying defreezing water for removal of ice or a drain conduit in fluid communication with the exterior of the ice making machine.

9 Claims, 8 Drawing Sheets

WATER SUPPLY SYSTEM FOR ICE MAKING MACHINE

RELATED APPLICATION

This is a continuation-in-part of U.S. patent application Ser. No. 07/071,260 filed on July 8, 1987, now abandoned.

BACKGROUND OF THE INVENTION

1. Field of the Invention

The present invention relates generally to ice making machines, and more particularly to a water supply system for ice making machines including a reversible circulating pump.

2. Description of the Prior Art

Heretofore, there have been proposed various water supply systems to be used in association with an ice making machine, as will be seen in FIGS. 14 to 16 of the accompanying drawings. In the water supply system shown in FIG. 14, there are installed, above an ice forming member 1 equipped with a cooling or evaporator pipe 1*a*, an ice forming water distribution pipe 2 and a deicing or defreezing water distribution pipe 3 which are in fluid communication with a water tank 4 through first and second circulating pumps 5 and 5*a*, respectively. Upon operation of the circulating pump 5, water (referred to as ice forming water) is supplied onto a freezing surface of the ice forming member 1 to cause an ice slab 1*b* to be formed and grow thereon. On the other hand, when the circulating pump 5*a* is operated, deicing or defreezing water is distributed over a rear surface of the ice forming member 1 to defreeze the ice slab 1*b* for removal thereof from the ice forming member. Reference character 4*a* denotes a water supply pipe connected to an external water service system (not shown) for supplying water to the water tank 4.

In the case of the water supply system shown in FIG. 15, the ice forming water distribution pipe 2 and the defreezing water distribution pipe 3 are connected to pipes incorporating first and second solenoid valves 7 and 7*a*, respectively. By energizing and deenergizing selectively the first and second solenoid valves 7 and 7*a*, ice forming or defreezing water can be supplied in a manner similar to that described in conjunction with FIG. 14.

FIG. 16 shows another known water supply system in which the ice forming water distribution pipe 2 and the deicing or defreezing water distribution pipe 3 are connected to a conventional three-way valve 7 so that ice forming water or defreezing water can be selectively fed to the ice forming member 1.

Although all the prior art water supply systems described above are so designed that the defreezing water is supplied from the water tank 4, there have also been known such water supply systems in which defreezing water is tapped from a separate water supply source or an external water supply system such as a city water supply service system.

The hitherto known ice making machines provided with water supply systems having arrangements such as shown in FIGS. 14 to 16 suffer from various and numerous shortcomings such as described below:

(1) First, in the case of the arrangement shown in FIG. 14, not only are two circulating pumps required but a control apparatus for controlling the operation of the pumps is required, thus involving high expenditure, as well as a relatively greater likelihood of failure and poor reliability in operation.

(2) Although the system shown in FIG. 15 can operate with the single circulating pump, two solenoid valves are required. Thus, this system suffers from disadvantages similar to those mentioned above.

(3) In the system shown in FIG. 16, the combination of one circulating pump with one solenoid valve is sufficient for realizing the intended operation cycle. However, the solenoid valve is constituted by a three-way valve. This makes it difficult to provide an inexpensive system while still assuring high reliability.

(4) Further, a problem existing in common with all water supply systems known heretofore is that a relatively large number of parts are required, whereby the space occupied by the system is necessarily increased, thus making it difficult to produce small-sized ice making machines.

SUMMARY OF THE INVENTION

It is therefore an object of the present invention to provide a water supply system for use in an ice making machine which system is capable of supplying water selectively to an ice forming member or another member as required from a water tank by using only one circulating pump.

With this object in view, the present invention in the broadest aspect thereof resides in an ice making machine including an ice forming member or assembly, cooling means operatively associated with the ice forming member and serving for refrigerating the latter with a coolant flowing internally through the cooling means, a water tank for storing ice forming water to be supplied to the ice forming member, ice forming water distribution means for delivering the ice forming water over the ice forming member, and piping means having one end connected to the water distribution means, and a circulating pump having an inlet port communicated to the water tank, wherein the circulating pump is constituted by a reversible circulating pump having a first discharge port connected to the piping means at the other end thereof for feeding water to the ice forming member and a second discharge port connected to another member different from the piping means.

In the ice making machine according to the present invention, water can be supplied to the ice forming water distribution means from the first discharge port of the reversible circulating pump through the piping means when the pump is rotated in one (or forward) direction, while water is supplied to the member other than the ice forming water distribution means from the second discharge port of the reversible circulating pump when the latter is rotated in the other (or reverse) direction.

In a preferred embodiment of the invention, the second discharge port of the reversible circulating pump is connected to one end of a defreezing water supply pipe having the other end communicated with defreezing (deicing) water distribution means which is adapted to distribute water over the rear surface of the ice forming member in the ice removal (deicing) cycle of the ice making machine. In another preferred embodiment of the present invention, the second discharge port of the pump may be connected to one end of a drain pipe having the other end positioned to open above the top open end of an overflow pipe mounted within the water supply tank for the purpose of discharging water remaining within the tank after the ice production cycle and possibly containing impurities at high concentration.

BRIEF DESCRIPTION OF THE DRAWINGS

The objects and advantages of the present invention will become more apparent by reading the following detailed description in conjunction with the accompanying drawings, in which like reference characters designate like or corresponding parts throughout the various views of the drawings and in which.

DESCRIPTION OF THE PREFERRED EMBODIMENTS

Figure 1:
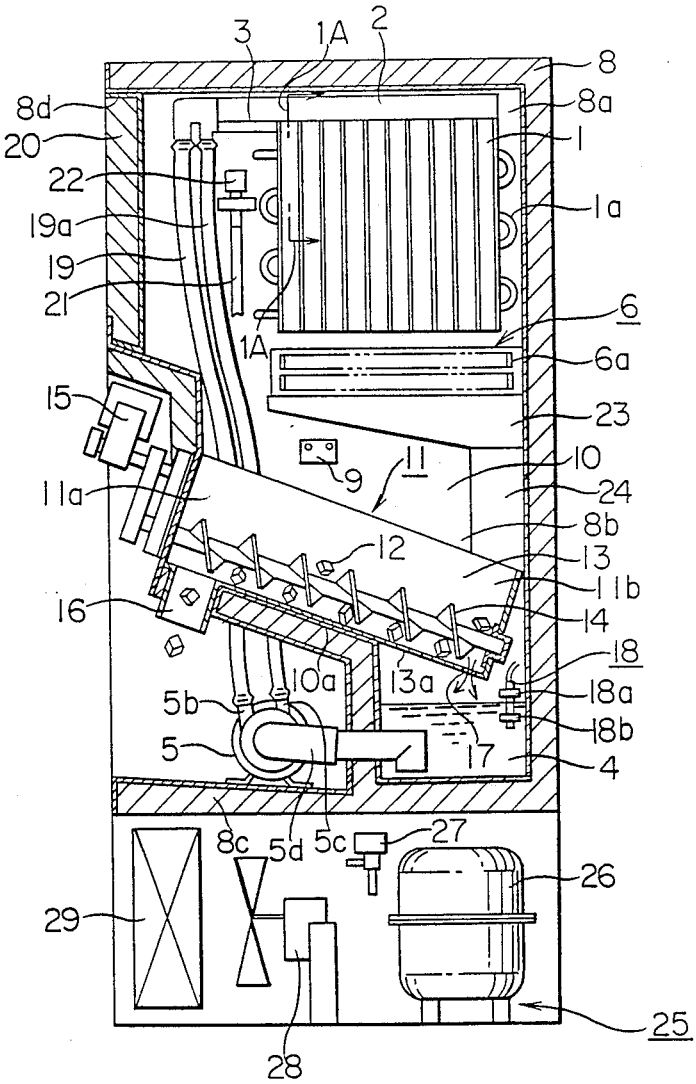
FIG. 1 is a schematic vertical sectional view showing an ice making machine incorporating a water supply system according to the first embodiment of the invention.
Figure 1A:
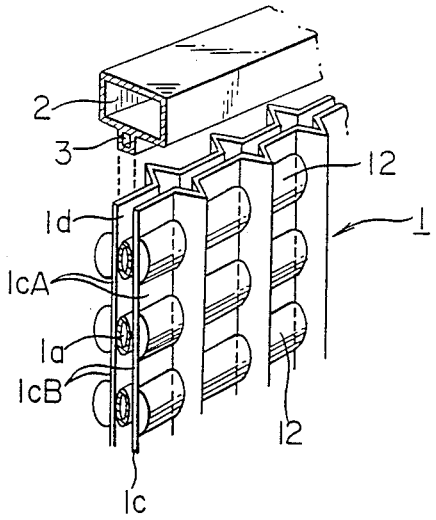
FIG. 1A is a fragmental perspective view showing an ice making member together with an ice forming water distribution pipe and a defreezing water distribution pipe in a section taken along the line 1A—1A in FIG. 1.

Now referring to the drawings and in particular to FIGS. 1 and 1A which show an ice making machine incorporating a water supply system according to the first embodiment of the invention, reference numeral 1 designates an ice forming member disposed within a heat-insulated box-like body (hereinafter referred to simply as a box) at an upper portion thereof. The ice forming member 1 is constituted by a pair of corrugated freezing plates 1*c* made of a material having a relatively low thermal conductivity such as, for example, stainless steel and disposed vertically with the respective rear surfaces of the plates 1*c* facing in opposition to each other with a predetermined distance therebetween. A cooling pipe 1*a* is disposed between the freezing plates 1*c* in a meandering pattern in heat exchange relation with the plates 1*c*, as can be clearly seen in FIG. 1A. An ice forming water distribution pipe 2 of a rectangular cross-section is disposed on the top edges of the freezing plates 1*c*, while a defreezing water distribution pipe 3 underlying the ice forming water distribution pipe 2 and having a substantially square cross-section is fitted within a space 1*d* defined between the defreezing plates 1*c*. The ice forming water distribution pipe 2 as well as the defreezing water distribution pipe 3 per se are of a known structure. More specifically, they are an integral structure and provided with a number of ice forming water and deicing water distributing orifices, respectively, wherein the ice forming water distributing orifices are oriented toward the freezing (ice forming) surfaces 1*c*A of the freezing plates 1*c*, while the defreezing water distributing orifices are oriented toward the rear surfaces 1*c*B of the freezing plates 1*c*. In the ice making machine including the ice forming member 1, there are formed ice pellets or pieces 12 of semi-cylindrical shape in section, as will be seen in FIG. 1A.

Formed within the thermally insulated box 8 in a lower portion 8*b* thereof is an ice piece storage chamber or ice stocker 10 provided with an ice storage level sensor 9 and in which an ice dispensing mechanism 11 is detachably mounted on an inclined bottom wall 10*a* in such an inclined state that a front end portion 11*a* of the mechanism 11 is positioned higher than the rear end portion 11*b*.

The ice piece dispensing mechanism 11 includes a box-like housing 13 formed of a resin material in an integral structure and having a storage capacity capable of storing therein an appropriate amount of ice pieces 12, a screw 14 mounted rotatably within the housing 13, and a screw drive unit 15 for driving the screw 14.

An ice piece exit 16 is formed in the bottom wall 13*a* of the housing 13 at the front end portion in the form of a downwardly extending tube, while a water exit opening(s) 17 is formed in the bottom wall 13*a* at the rear end portion thereof.

Provided within the ice storage chamber 10 at the rear side thereof is a water tank 4 which is formed integrally with the ice storage chamber 10 in the form of a downwardly extending recess so that water within the housing 13 of the ice piece dispensing mechanism 11 can return to the water tank 4 through the water exit opening 17. Disposed within the water tank 4 is a water level detector in the form of a float switch 18 having an upper limit switch element 18*a* and a lower limit switch element 18*b*.

Mounted fixedly on a bottom wall plate 8*c* of the thermally insulated box 8 is a circulating pump 5 which has an inlet port 5*d* in fluid communication with the water tank 4 and a water discharge port 5*b* connected to a water supply pipe 19 which in turn is connected to the ice forming water distribution pipe 2 so that water is distributed over the ice forming surfaces 1*c*A of the ice forming member 1. Additionally, the circulating pump 5 has a second water discharge port 5*c* connected to a defreezing water pipe 19*a* which in turn is connected to the defreezing water distribution pipe 3 described previously.

An opening 8*d* formed in the upper portion 8*a* of the thermally insulated box 8 is provided with an openable or removable cover 20. Mounted within the box 8 at a position below and adjacent to the cover 20 is a water supply valve 22 connected to a tap of an external water supply service system (not shown) for charging water into the water tank 4 by way of a feed-water pipe 21.

Mounted within the box 8 at a location beneath the ice forming member 1 is an ice piece guide plate 6 which is positioned at an inclined position and is provided with a number of holes or slots 6*a*. The degree of inclination and the size of the holes 6*a* of this guide plate 6 are so selected that the ice pieces can be slidably moved into the ice storage chamber 10 without passing through the holes 6*a*, while water is allowed to pass through the holes 6*a* to be collected in the water collecting pan 23 and subsequently fed back to the water tank 4 through a water guide trough 24.

Disposed under the bottom wall 8*c* of the thermally insulated box 8 is a machine chamber within which a known refrigerating unit 25 is disposed for supplying a coolant to the cooling pipe 1*a*. The refrigerating unit 25 is composed of a compressor 26, a hot gas valve 27 and a condenser 29 connected to one another through conduits (not shown). The condenser 29 is cooled by the air flow produced by a motor-driven blower 28.

Figure 2:
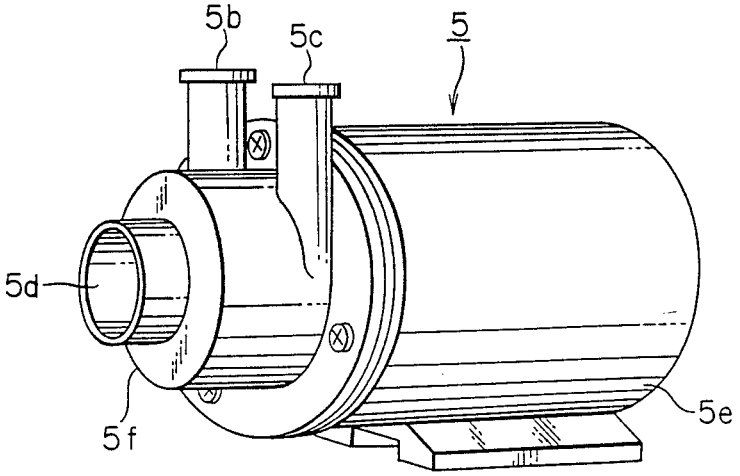
FIG. 2 is a perspective view showing a reversible circulating pump which can be used in the ice making machine shown in FIG. 1.

FIG. 2 shows the outer appearance of the circulating pump assembly 5 which includes a motor section 5*e*, and a pump section 5*f* provided with the ice forming water discharge port 5*b*, the defreezing water discharge port 5*c* and the inlet port 5*d* mentioned hereinbefore. As will be seen in FIG. 2, the discharge ports 5*b* and 5*c* are formed in a cylindrical housing wall of the pump section 5*f* in a circumferentially spaced relationship with each other and they extend substantially in parallel in a direction tangential to the circumference of the cylindrical housing wall. On the other hand, the inlet port 5*d* is so formed as to extend in the axial direction in alignment with a rotary pump shaft 32 (FIG. 4).

Figure 3:
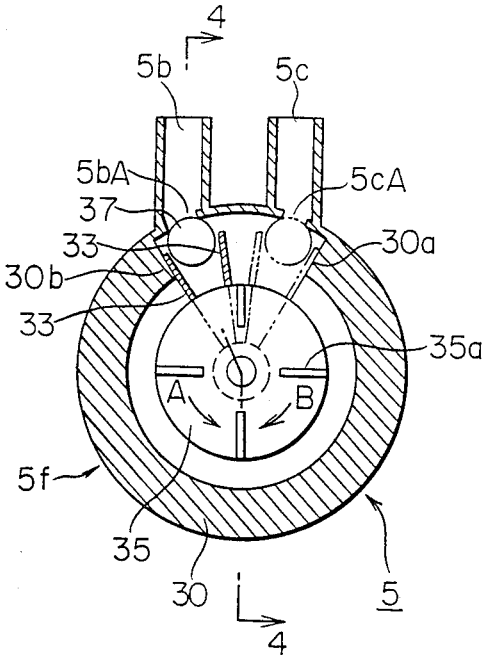
FIG. 3 is a sectional view of the same circulating pump taken in a vertical plane extending through first and second discharge ports of the pump.
Figure 4:
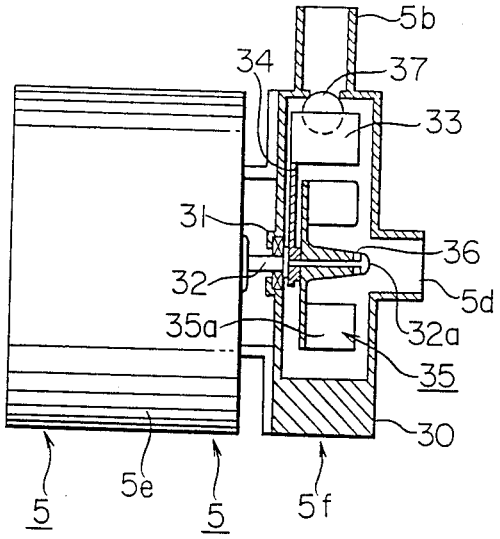
FIG. 4 is an elevational view of the circulating pump shown in FIG. 2 and shows a portion of the pump in a sectional view taken along the line 4—4 in FIG. 3.
Figure 5:
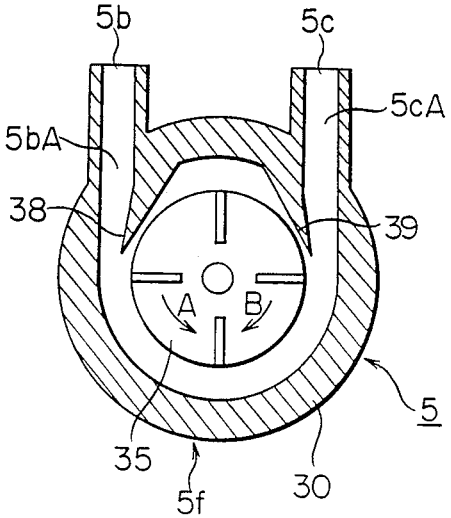
FIG. 5 is a view similar to FIG. 3 and shows a modified structure of the circulating pump.
Figure 10:
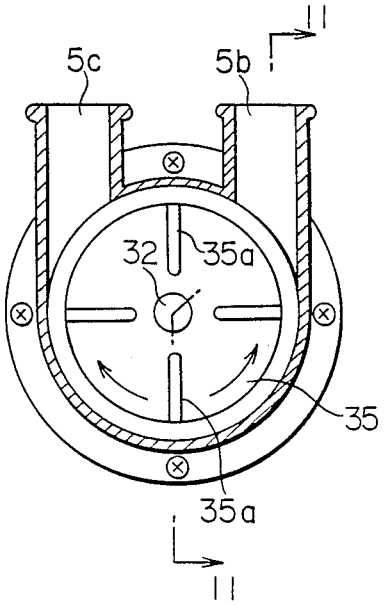
FIG. 10 is a view similar to FIG. 3 and shows still another modified structure of the circulating pump.
Figure 11:
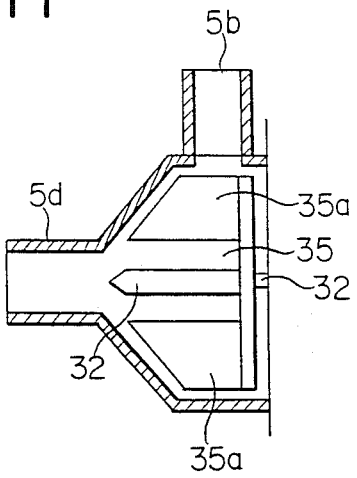
FIG. 11 is a sectional view of the same taken along the line 11—11 in FIG. 10.

Now, a description will be given in more detail of the structure of the circulating pump 5 which can be employed in the water supply system according to the invention by referring to FIGS. 3 to 11, in which FIGS. 3 and 4 show the first exemplary embodiment of the circulating pump, FIG. 5 shows the second embodiment, FIGS. 6 to 9 show the third embodiment and FIGS. 10 and 11 show the fourth embodiment of the circulating pump.

First, referring to FIGS. 3 and 4 showing the first embodiment of the circulating pump, the pump 5*f* includes a housing or casing 30 into which a rotatable shaft 32 of an electric motor 5*e* extends through an interposed seal 31. A switching lever 34 having a pair of plates 33 and an impeller 35 composed of a plurality of vanes (four vanes in the case of the illustrated embodiment) are fixedly mounted on the motor shaft 32 at a portion thereof projecting into the pump casing 30. A spring member 36 is interposed between the impeller 35 and an enlarged end portion 32*a* of the shaft 32 for resiliently urging or biasing the impeller 35 toward the switching lever 34.

A switching valve 37 having a ball valve element of a diameter greater than that of the discharge port is disposed between the plates 33 mentioned above so that a first opening 5*b*A formed in the ice forming water discharge port 5*b* and a second opening 5*c*A formed in the defreezing water discharge port 5*c* can be selectively and exchangeably closed by the ball valve element 37 in response to the operation of the switching lever 34. Formed in the inner wall of the casing 30 are offset or shoulder portions 30*a* and 30*b*, the shoulder portion 30*a* defining a stopper for the switching lever 34 on the side of the defreezing water discharge port 5*c*, while the shoulder 30*b* serves as the stopper for delimiting the swing of range of swing of the switching lever 34 on the side of the water forming water discharge port 5*b*. Thus, either the valve opening 5*b*A or 5*c*A can be closed or opened by the switching valve 37 depending on the rotating direction of the impeller 35, as will be hereinafter described in more detail in conjunction with the operation of the ice making machine.

Next, a description will be given of the second embodiment of the circulating pump shown in FIG. 5. Referring to the figure, ribs 38 and 39 are formed at edge portions of the first and second inlet openings 5*b*A and 5*c*A of the ice forming water discharge port 5*b* and the defreezing water discharge port 5*c*, respectively, and extend toward the impleller 35 to the vicinity of the peripheral edge thereof. With this arrangement of the circulating pump, a difference in pump lift is produced depending upon the rotational direction of the impeller 35, whereby water can flow out from either the ice forming water discharge port 5*b* or the freezing water discharge port 5*c* without the need for the provision of a valve due to difference in the lift. Thus, there is provided a so-called two-lift type circulating pump.

Turning to the third embodiment of the circulating pump shown in FIGS. 6 to 9, a switching or change-over ring 42 provided with an ice forming water gate aperture 40 and a defreezing water gate aperture 41 is mounted for reversible rotation (as indicated by arrows A and B) around the impeller 35 also mounted rotatably within the casing 30 of the pump 5*f*. As will be clearly seen in FIGS. 5 and 7, the change-over ring 42 is integrally formed with a thick wall section 43 having first and second end faces 43*a* and 43*b* which can be alternately brought into respective alignment positions where they extend flush or coextensively with walls 5*b*B and 5*c*B defining the ice forming water discharge port 5*b* and the defreezing water discharge port 5*a*, respectively. Further formed substantially in coextensive relation with the first and second end faces 43*a* and 43*b* are stoppers 43*c* and 43*d*, respectively, which project radially outwardly from the former.

Figure 6:
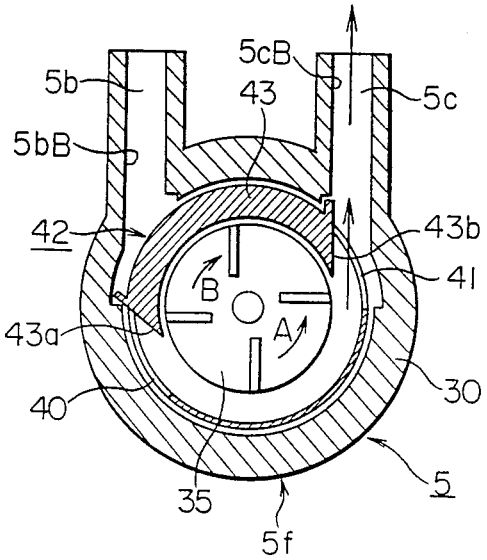
FIGS. 6 and 7 are views similar to FIG. 3 and show a further modified structure of the circulating pump in the different operating states, respectively.
Figure 7:
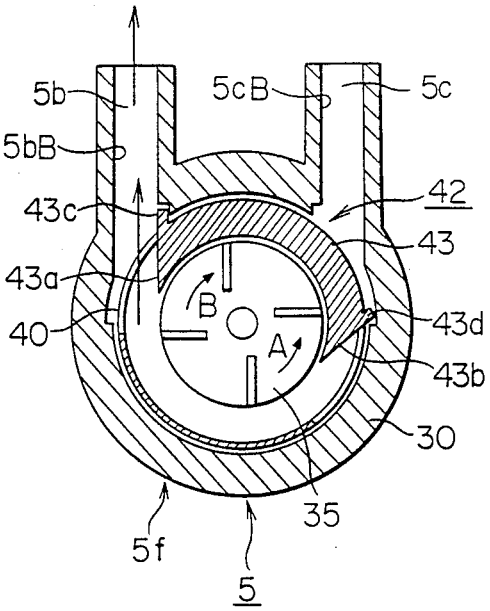
Figure 8:
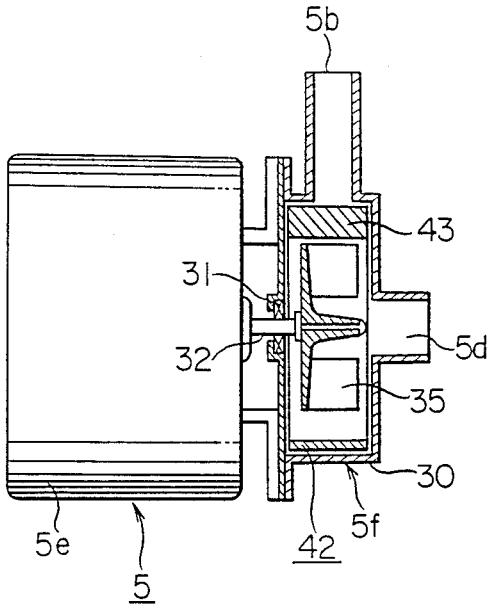
FIG. 8 is a view similar to FIG. 4 and shows the further modified structure of the circulating pump.
Figure 9:
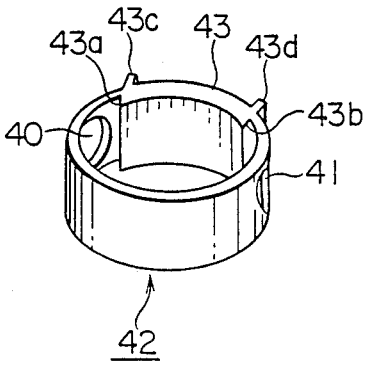
FIG. 9 is a perspective view showing a change-over ring employed in the further modified embodiment of the invention.

In operation, when the impeller 35 is rotated in the direction indicated by the arrow A in FIG. 6, the change-over ring 42 is caused to rotate to the position in which the second end face 43*b* becomes flush with the wall surface 5*c*B under the influence of hydraulic pressure exerted by the water flow, whereby the defreezing water is discharged from the pump 5. On the other hand, when the impeller 35 is rotated in the direction indicated by the arrow B shown in FIG. 7, the change-over ring 42 is caused to rotate in the clockwise direction to the position at which the first end face 43*a* becomes flush with the wall surface 5*b*B, to thereby allow the ice forming water to flow out from the discharge port 5*b*.

In the case of the fourth embodiment of the circulating pump shown in FIGS. 10 and 11, there is provided no positive means such as a switching lever or a change-over ring for positively preventing water from flowing out through the undesired discharge port. It should however be noted that each of four vanes 35*a* of the impeller has a free top edge slanted radially in such a manner that the axial length of the vane is progressively decreased toward the radially outermost edge, as can be seen in FIG. 11. The housing of the pump 5*f* is also configured so as to conform with the overall geometry of the vane array of the impeller 35. This structure can also assure the intended operation.

Now, operation of the ice making machine according to the first embodiment of the invention described in conjunction with FIGS. 1, 1A and 2 will be described on the assumption that the circulating pump 5 shown in FIGS. 3 and 4 is employed.

Upon energization in response to the closing of a main switch (not shown), the ice making machine starts operation, beginning with the defreezing cycle. First, the compressor 26 is activated with the hot gas valve 27 being opened. As a result, the ice forming member 1 is supplied with a hot gas, whereby heating of the ice forming member 1 is initiated, as is well known in the art. On the other hand, at this time point, the upper limit switch 18*a* mounted within the water tank 4 is in the off-state. Consequently, the water supply valve 22 is opened to allow water to be fed to the water tank 4 through the water supply pipe 21.

Upon start of the rotation of the drive motor 5*e* for the circulating pump 5 in the forward direction (e.g. counterclockwise) as indicated by the arrow A in FIG. 3, the switching lever 34 starts to rotate in the same direction A as the impeller 35 with the ball valve element 37 being held between the plates 33 because the impeller 35 is pressed against the switching lever 34 under the force of the spring member 36. The rotation of the switching lever 35 is stopped when one of the plate members 33 (left-hand one as viewed in FIG. 3) strikes against the stopper 30*b* provided on the side of the ice forming water discharge port 5*c*, whereupon the ball valve element 37 closes the first opening or aperture 5*b*A.

When the impeller 35 continues to rotate in the state described just above, pumping-up of water is initiated, whereby water is fed from the defreezing water discharge port 5*c* to the defreezing water distribution pipe 3 through the defreezing water pipe 19*a* to be distributed over the rear surfaces of the freezing plates 1*c*, respectively. In this state, the ball valve element 37 remains in the position to block the ice forming water discharge port 5*b* under the hydraulic pressure exerted by the water flow, thus assuring operation with high efficiency while leakage is suppressed to a minimum. During the pumping operation, thrust of significant magnitude is produced on the side of the inlet port 5*d*, with the result that the impeller 35 tends to move toward the intake port 5*d* against the tension of the spring member 36, whereby the switching lever 34 is disengaged from the impeller 35. Thus, the latter can be rotated without being subjected to any appreciable friction. Besides, the gap between the impeller 35 and the casing 30 is decreased significantly, whereby the dynamic pumping-up performance or characteristics of the pump can be further enhanced.

Defreezing water distributed over the rear surfaces of the freezing plates 1*c* of the ice forming member 1 is recovered and collected in the water tank 4 through the perforated ice piece guide plate 6, the water droplets receiving pan 23 and the guide trough 24. When a predetermined amount of water is thus stored within the water tank 4, the upper limit switch 18*a* detects the water level. In response to the detection signal of the upper limit switch 18*a*, the water supply valve 22 is closed to stop the water supply. In the meantime, the defreezing process proceeds with the aid of the hot gas and the defreezing water described above, with the result that the heating of the ice making member 1 is accelerated.

After passage of a predetermined time, the defreezing operation cycle is completed in response to a timer signal or an output signal of an appropriate temperature sensor, being followed by the activation of the subsequent ice production cycle.

Upon starting of the ice production cycle, the hot gas valve 27 is first closed, while the operation of a blower drive motor 28 is started. On the other hand, the circulating pump 5 starts rotation in the reverse direction (clockwise direction) as indicated by the arrow B after a pause of a predetermined time.

Upon start of the impeller rotation in the direction B, the switching lever 34 is swung in the same direction as the impeller 35, being accompanied with the movement of the ball valve element 37 toward the defreezing water discharge port 5*c* until one of the plates 33 (the right-hand plate as viewed in FIG. 3) bears against the stopper 30*a* provided on the side of the defreezing water discharge port 5*c*, whereupon the second opening or aperture 5*c*A is blocked by the ball valve element 37. On the other hand, the ice forming water discharge port 5*b* is changed to the opened state, with the result that water is distributed on the ice forming surfaces 1*c*A of the freezing plates 1*c*, respectively, after having passed through the ice forming water supply pipe 19 and the ice forming water distribution pipe 2.

At the same time, the freezing plates 1*c* are cooled down by the coolant supplied from the compressor 26 and flowing through the cooling pipe 1*a*, whereby ice pellets or pieces 12 of a crescent shape begin to be formed at locations on each ice forming surface 1*c*A which correspond to those of the cooling pipe 1*a*. When the ice pellets have grown to a predetermined size of a predetermined shape, the water level within the water tank 4 is correspondingly lowered, which is detected by the lower limit switch element 18*b*. A control apparatus of any suitable known structure (not shown) responds to the detection output of the level sensor switch element 18*b* and then changes over the ice production cycle to the defreezing cycle, which results in the stoppage of the blower drive motor (fan motor) 28 and the circulating pump 5, while the water supply valve 22 and the hot gas valve 27 are opened. Water is thus supplied to the water tank 4 through the water feed pipe 21 to supplement the amount of water consumed by the preceeding ice production cycle.

Thereafter, upon passage of a predetermined time, the circulating pump 5 starts rotation in the forward direction, and the switching lever 34 is swung in the direction A with the ball valve element 37 being dislodged from the second opening 5*c*A to the first opening 5*b*A, resulting in the ice forming water discharge port 5*b* being closed and the defreezing water discharge port 5*c* being opened.

It should be mentioned here that water droplets spattered around without dropping through the holes 6*a* formed in the ice pellet guide plate 6 in the ice production cycle are received within the housing 13 to be subsequently fed back to the water tank 4 through the water guide hole 17.

When the defreezing cycle is again started, the blower drive motor 28 is stopped and the water supply valve 22 and the hot gas vavle 27 being opened. Water then leaves the circulating pump 5 from the defreezing water discharge port 5*c* to be distributed over the rear surfaces of the freezing plates 1*c* and recovered to the water tank 4 through the ice piece guide plate 6 and the water droplet receiving pan 23.

When water to be used during the subsequent ice production cycle has been stored within the water tank 4 up to a predetermined upper limit level, this state is detected by the upper limit sensor switch 18*a*, whereby the water supply valve 22 is closed. When a defreeze thermostatic circuit (not shown) detects the state in which all the ice pieces have been removed from the ice forming member 1 and that the temperature thereof has attained a predetermined value, the hot gas valve 27 is closed to allow the ice production cycle to be started again after the passage of a predetermined time set at a timer (not shown).

In this way, the ice removal and ice production cycles are alternately performed repeatedly until the present ice storage state has been detected by the storage detecting switch 9.

In the foregoing description of operation of the ice making machine, it has been assumed that the circulating pump 5 according to the first embodiment shown in FIGS. 3 and 4 is employed. However, it will be readily appreciated that substantially the same operation as described above can equally take place even when the circulating pumps according to the other embodiments are used. More specifically, referring to FIG. 5 which shows the second embodiment of the circulating pump, upon rotation of the impeller 35 in the direction A, the pump lift on the side of the defreezing water discharge port 5*c* is increased, whereby water flow is produced along the freezing water rib 39 to be discharged from the port 5*c* for the defreezing water discharge. On the other hand, the lift on the side of the ice forming water discharge port 5*b* is too low for the water to be distributed from the ice forming water distribution pipe 2. On the other hand, rotation of the impeller 35 in the direction B increases the pump lift on the side of the ice forming water discharge port 5*b*, resulting in water flow along the ice forming water guide rib 28 to be discharged from the port 5*b*. In this case, the pump lift on the side of the defreezing water discharge port 5*c* is too low for water to be distributed from the associated pipe 3. In the case of the third embodiment of the circulating pump shown in FIGS. 6 to 9, rotation of the impeller 35 in the direction A is accompanied by the opening of the freezing water gate 41 to allow the defreezing water to be discharged for removing the ice pieces by defreezing or deicing. On the other hand, rotation of the impeller 35 in the direction B causes the ice forming water gate 40 to be opened, allowing water to be supplied for ice production. In the use of the circulating pump 5 shwon in FIGS. 10 and 11, rotation of the impeller in the direction to discharge water from one port will also cause water to flow out from the other port. However, the hydraulic pressure of water discharged from the other port is too low for the water head to reach the ice forming water distribution pipe 2 or the defreezing water distribution pipe 3. Thus, the circulating pump according to this fourth embodiment can operate substantially in the same manner as those described above.

It should be mentioned that the invention is not restricted to the circulating pump structures described above but other circulating pump structures can be adopted for substantially the same effects, so far as an operation where the change-over in the rotating direction of the circulating pump brings about an exchange of the discharge ports with each other can be ensured.

By virtue of the structure and operation of the ice making machine according to the first embodiment of the present invention described above, the ice making apparatus can exhibit numerous advantages such as, those described below, for example:

(1) Since the changing-over between the ice forming water supply and the defreezing water supply can be positively achieved simply by changing the rotating direction of the single circulating pump without providing any change-over valve in the water supply pipe on the way to the associated distribution pipes, the manufacturing costs can be significantly reduced while enhancing the reliability in operation.

(2) Since a system according to the invention can be implemented with a relatively small number of parts, the water circulating circuit configuration can be greatly simplified, whereby the ice making machine as a whole can be provided in a significantly reduced size.

(3) Since the ice removal or separation can be accomplished with a minimum water supply without any appreciable water loss, not only the water circulating circuit but also the control circuit can be much simplified, thus allowing an ice making machine for an automatic vending machine to be manufactured in an extremely small size.

Next, an ice making machine implemented according to a second embodiment of the present invention will be described by referring to FIG. 12. The ice making machine shown in this figure is so designed as to employ the reversible circulating pump 5 shown in FIG. 10 and 11. For this end, a pressure valve 50 described hereinafter is provided in association with the discharge port 5*c* of the pump. However, it should be understood that any one of the circulating pumps shown in FIGS. 3 to 9 or other pumps capable of exhibiting the same or equivalent functions and effects can be equally used in the ice making machine shown in FIG. 12. In such cases, the pressure valve 50 can be removed.

Figure 12:
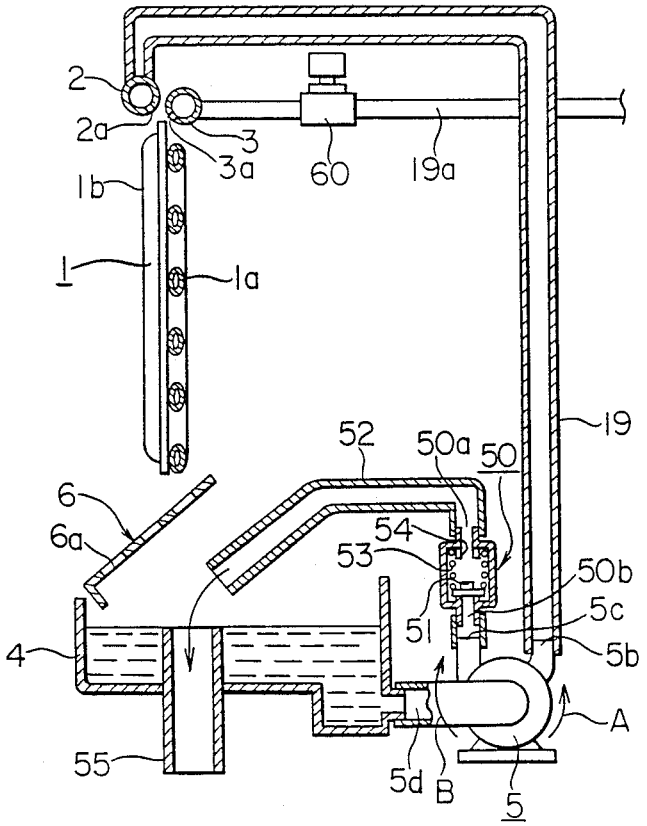
FIG. 12 is a schematic vertical sectional view showing an ice making machine equipped with the water supply system according to another embodiment of the invention.

In the ice making machine shown in FIG. 12, the ice forming water distribution pipe 2 is communicated to the discharge port 5*b* of the circulating pump 5. However, the defreezing water distribution pipe 3 is connected to an external water supply system through the defreezing water pipe 19*a* incorporating an electromagnetic valve 60 instead of being connected to the circulating pump 5. The other discharge port 5*c* of the circulating pump 5 is connected to a drain pipe 52 through the pressure valve 50. The drain pipe 52 has the other end directed toward the top open end of an overflow pipe 55 mounted within the water tank 4.

The pressure valve 50 includes a hollow housing having top and bottom walls formed with openings 50*a* and 50*b*, respectively. A valve element 51 is disposed within the housing and is usually urged downwardly to thereby close the bottom opening 50*b* under the influence of a coil spring member 53. Formed in the vicinity of the top opening 50*a* is a projection 54 which serves as a sort of stopper for preventing the top opening 50*a* from being closed by the valve element 51 upon upward displacement thereof, as will be described hereinafter.

In the ice making machine shown in FIG. 12, the operation starts with the defreezing cycle in response to the turning-on of a main switch (not shown). In the defreezing or deicing cycle, the solenoid valve 60 is opened, whereby water is fed from the external water supply service system to the defreezing water distribution piep 3 through the water supply pipe 19*a* to be distributed over the ice forming member 1 and ultimately collected in the water tank 4. Upon occurrence of overflow through the pipe 55, the defreezing cycle is then replaced by the freezing cycle with the solenoid valve 60 being closed while the circulating pump 5 is rotated in the direction indicated by the arrow A. Consequently, water within the tank 4 is supplied to the ice forming distribution pipe 2 through the pipe 19 to be distributed over the freezing surfaces of the ice forming member 1.

During this ice production cycle, the circulating pump 5 continues to rotate in the direction indicated by the arrow A. Accordingly, the hydraulic pressure applied to the valve element 51 of the pressure valve 50 is smaller than the spring force of the coil spring 53, whereby the opening 50*b* of the valve 50 is maintained in a closed state by the valve element 51, preventing water from flowing into the drain pipe 52.

When a predetermined amount of the pieces 1*b* has been formed on the ice forming member 1, accompanied with a corresponding lowering in the water level within the tank 4, the ice production cycle comes to a halt and the defreezing cycle is started. Then, the solenoid valve 60 is opened, and the circulating pump is driven in the direction indicated by the arrow B. As the result, the hydraulic pressure applied to the valve element 51 overcomes the spring force of the coil spring 53. Thus, the water resulting from the preceding ice production cycle and remaining within the tank possibly with an increased impurity concentration will flow out through the overflow pipe 55 from the drain pipe 52. After passage of a predetermined time, the rotation of the circulating pump 5 in the direction B is stopped, while the solenoid valve 60 is maintained in the opened state until overflow takes place within the water tank 5.

The change-over in the rotating direction of the circulating pump 5 easily can be accomplished by changing over the energizing current flow to the windings referred to as the main winding and the auxiliary winding of a condenser motor employed as the drive motor 5*e*.

Figure 13:
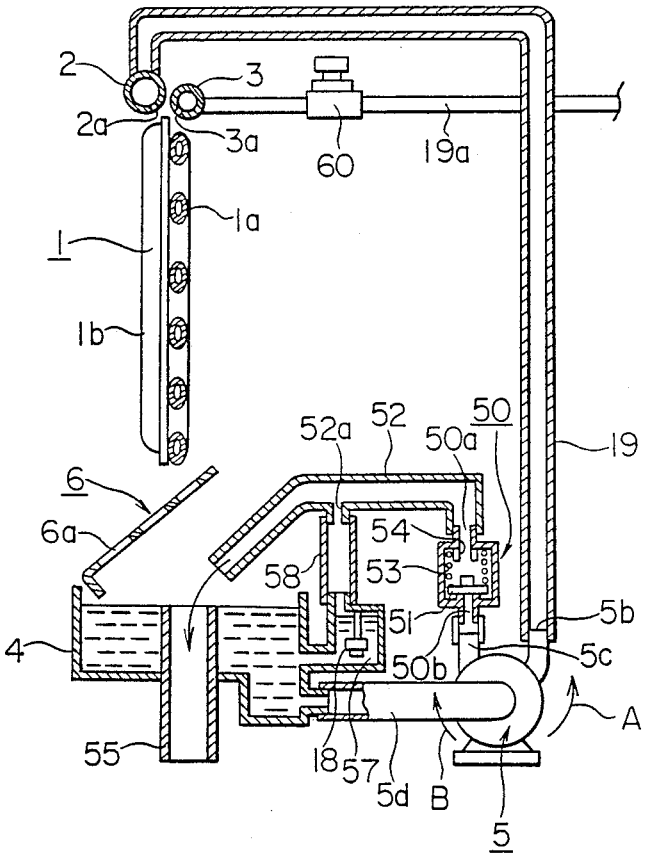
FIG. 13 is a vertical sectional view showing a modified structure of the ice making machine shown in FIG. 12.
Figure 14:
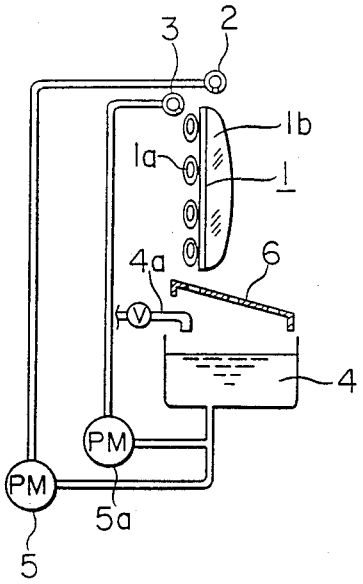
FIGS. 14 to 16 are elevational views showing schematically various conventional water supply systems for the ice making machines.
Figure 15:
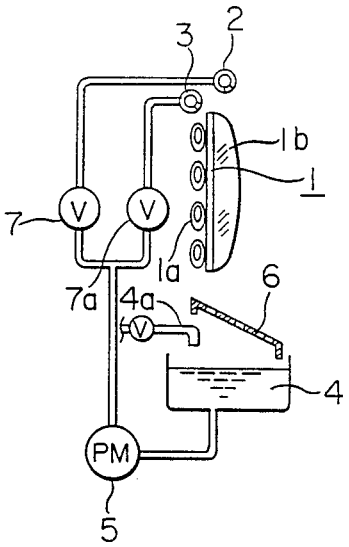
Figure 16:
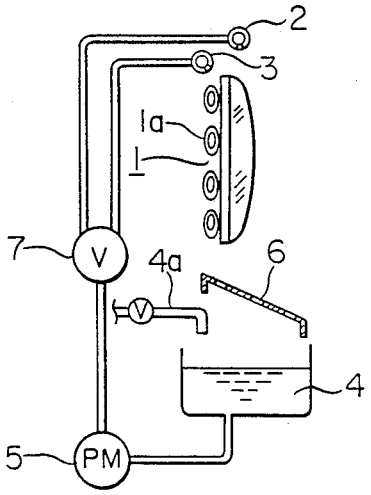

FIG. 13 shows a modification of the ice making machine shown in FIG. 12. Referring to FIG. 13, the drain pipe 52 includes a branching port 52*a* which is communicated through a cleaning pipe 58 to a sub-tank 57 provided integrally with the water tank 4 and communicated with the latter along the bottom portion. A float switch 18 for detecting the completion of ice production is provided within the sub-tank 57 for the purpose of preventing any degradation in the accuracy with which completion of the ice production is detected under the influence of variations in the water level that are brought about mainly by circulation of water during the ice production cycle.

When the circulating pump 5 is rotated in the direction indicated by the arrow B during the defreezing cycle, water remaining in the tank 4 is drained into the overflow pipe 55 from the drain pipe 55 through the discharge port 5*c* and the pressure valve 50 and additionally fed to the sub-tank 57 through the branch port 52*a* and the cleaning tube 58 to be subsequently transferred to the tank 4. By virtue of the cleaning water flow through the branch port 52*a* as well as the tube 58 and the sub-tank 57, the sub-tank 57 and the float switch 18 which are susceptible to deposition or sedimentation of impurities are cleaned, whereby not only the water tank 4 is maintained in a clean state but also the float switch 18 for detecting completion of the ice production cycle can be protected against erroneous operation.

As will be appreciated from the above description, in the case of the ice making machines shown in FIGS. 12 and 13, drainage of the residual water after the ice production cycle can be performed automatically in every defreezing cycle, whereby concentration of impurities contained in the residual water can be prevented from being increased, which in turn means that the piping of the water flow system can be protected against deposition or sedimentation of impurities. Thus, it is possible to perform the ice manufacturing operation with very high efficiency while protecting the ice making machine from degradation in the ice producing capability and obstacles to normal operation such as blockage of the distributing orifices.

Figure 17:
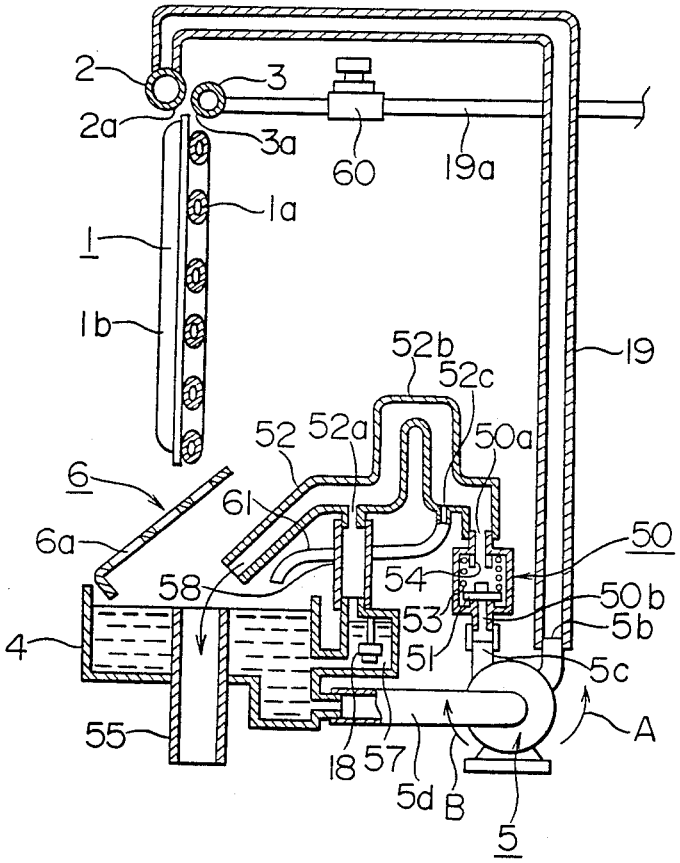
FIG. 17 shows, in vertical section, a modification of the ice making machine shown in FIG. 13.

Referring to FIG. 17, there is shown a modification of the water supply system in FIG. 13, which differs therefrom in that the drain conduit 52 is formed with a substantially U-shaped riser portion 52*b* at a location between the opening 50*a* and the branch port 52*a*; a drain port 52*c* is formed in the bottom of the lower half of the drain conduit 52 at a location between the pressure valve 50 and the riser portion 52*b*; and the drain port 52*c* has connected thereto an additional drain pipe 61 so that its extreme open end is positioned over the water tank 4.

It will be appreciated that since the riser portion 52*b* is provided and the drain pipe 61 extends to the water tank 4, any leakage water flowing through the pressure valve 50 during the ice making mode of the operation is allowed to return into the water tank 4. The effective height of the riser portion 52*b* and the inner diameter of the drain port 52*c* can be determined depending on a possible maximum amount of leakage from the pressure valve 50.

Furthermore, it will be readily understood by those skilled in the art that the above-mentioned riser pipe 52*b* and the drain port 52*c* may be provided in the drain conduit 52 shown in FIG. 12.

It will be understood that the above description of the present invention is susceptible to various modifications, changes, and adaptations, and the same are intended to be comprehended within the meaning and range of equivalents of the appended claims.

What is claimed is:

1. An ice making machine, comprising:

an ice forming member;

cooling means operatively cooperating with said ice forming member for cooling said ice forming member during an ice production cycle of said ice making machine, said cooling means being supplied with a coolant flowing internally therethrough;

a water tank for storing ice forming water to be supplied to said ice forming member during said ice production cycle;

water distribution means for supplying said ice forming water into said ice forming member during said ice production cycle;

first piping means having one end connected to said ice forming water distribution means;

second piping means directing water toward a location other than said ice water making water distribution means and having a drain conduit with one end in fluid communication with the exterior of said ice making machine; and a reversibly rotatable circulating pump having an intake port communicated with said water tank, a first discharge port connected to the other end of said first piping means for delivering ice forming water to said ice forming member during said ice production cycle, and a second discharge port disposed at a distance from said first discharge port in the circumferential direction and connected to the other end of said second piping means for discharging the water from said water tank to a location outside said ice making machine during a deicing cycle of said ice making machine, said drain conduit having valve means therein responsive to the pressure of water fed from said circulating pump for closing said drain conduit during the ice production cycle and opening said drain conduit during said deicing cycle.

2. An ice making machine, comprising:

an ice forming member;

cooling means operatively cooperating with said ice forming member for cooling said ice forming member during an ice production cycle of said ice making machine, said cooling means being supplied with a coolant flowing internally therethrough;

a water tank for storing ice forming water to be supplied to said ice forming member during said ice production cycle;

water distribution means for supplying said ice forming water into said ice forming member during said ice production cycle;

first piping means having one end connected to said ice forming water distribution means;

second piping means directing water toward a location other than said ice water making water distribution means; and a reversibly rotatable circulating pump having an intake port communicated with said water tank, a first discharge port connected to the other end of said first piping means for delivering ice forming water to said ice forming member during said ice production cycle, and a second discharge port disposed at a distance from said first discharge port in the circumferential direction and connected to said second piping means for discharging the water from said water tank to a location other than said ice making water distribution means machine during a deicing cycle of said ice making machine; and defreezing water distribution means connected to said second piping means in operative association with said ice forming member for distributing defreezing water onto said ice forming member during said deicing cycle.

3. An ice making machine according to claim 2, wherein said water circulating pump includes a housing having formed therein said intake port, said first discharge port and said second discharge port, an impeller disposed rotatably within said housing and a rotatable shaft coupled to said impeller, and wherein water guide ribs each extending towards said impeller are formed in the inner wall of said housing adjacent to water inlet openings of said first and second discharge ports, respectively.

4. An ice making machine according to claim 2, wherein said water circulating pump includes a housing having formed therein said intake port, said first discharge port and said second discharge port, an impeller disposed rotatably within said housing, a rotatable shaft coupled to said impeller, and a lever mounted rotatably on said rotatable shaft and including a pair of plate members and a ball member held between said plate members, and wherein radially outwrdly extending offset portions are formed in the inner wall of said houding adjacent to water inlet openings of said first and second ports, respectively, either said first or second discharge port being substantially blocked by said ball member when either one of said pair of plate members engages with an associated one of said offset portions.

5. An ice making machine according to claim 2, wherein said water circulating pump includes a housing having formed therein said intake port, said first discharge port and said second discharge port, an impeller disposed rotatably within said housing with an annular space, a rotatable shaft coupled to said impeller, a change-over ring disposed to be bidirectionally rotatable within a predetermined angular range in coaxial relation to said impeller, said change-over ring having formed therein an ice forming water gate aperture and a defreezing water gate aperture which are selectively communicated with said first and second discharge ports depending on the direction in which said ring is rotated.

6. An ice making machine, comprising:

an ice forming member;

cooling means operatively cooperating with said ice forming member for cooling said ice forming member during an ice production cycle of said ice making machine, said cooling means being supplied with a coolant flowing internally therethrough;

a water tank for storing ice forming water to be supplied to said ice forming member during said ice production cycle;

water distribution means for supplying said ice forming water into said ice forming member during said ice production cycle;

first piping means having one end connected to said ice forming water distribution means;

second piping means directing water toward a location other than said ice water making water distribution means and having a drain conduit with one end in fluid communication with the exterior of said ice making machine; and a reversibly rotatable circulating pump having an intake port communicated with said water tank, a first discharge port connected to the other end of said first piping means for delivering ice forming water to said ice forming member during said ice production cycle, and a second discharge port disposed at a distance from said first discharge port in the circumferential direction and connected to the other end of said second piping means for discharging the water from said water tank to said second piping means; and an overflow pipe having an open top end and provided in said water tank so as to be in fluid communication with the exterior of said ice making machine, said drain conduit having said one end oriented toward the open top end of said overflow pipe.

7. An ice making machine according to claim 6, further including a sub-tank disposed in fluid communication with said water tank, means disposed in said sub-tank for detecting completion of ice production, and a cleaning tube branching from said drain conduit and in fluid communication with said sub-tank.

8. An ice making machine according to claim 6, wherein said drain conduit has valve means therein for closing said drain conduit during the ice production cycle and opening said drain conduit during the deicing cycle, a riser portion disposed at a location downstream of said valve means with respect to a possible stream of leakage water flowing through said valve means during the ice production cycle, and a drain pipe for guiding the leakage water into said water tank, said drain pipe having opposite open ends, one end being in fluid communication with the interior of said drain conduit at a location between said riser portion and said valve means, and the other being disposed over said water tank.

9. An ice making machine according to claim 8, further including a sub-tank disposed in fluid communication with said water tank, means disposed in said sub-tank for detecting completion of ice production, and a cleaning tube branching from said drain conduit at a location downstream of said riser portion and extending to said sub-tank so as to be in fluid communication therewith.

* * * * *